United States Patent [19]

Horrall et al.

[11] Patent Number: 4,476,572

[45] Date of Patent: Oct. 9, 1984

[54] PARTITION SYSTEM FOR OPEN PLAN OFFICE SPACES

[75] Inventors: Thomas R. Horrall, Harvard; Parker W. Hirtle, Lexington, both of Mass.

[73] Assignee: Bolt Beranek and Newman Inc., Cambridge, Mass.

[21] Appl. No.: 303,496

[22] Filed: Sep. 18, 1981

[51] Int. Cl.[3] ..... H04R 3/00; H04K 3/00

[52] U.S. Cl. ..... 381/73; 179/1.5 M

[58] Field of Search ..... 179/1.5 M, 1 AA; 381/71, 73

[56] References Cited

U.S. PATENT DOCUMENTS

| | | | |
|---|---|---|---|
| 3,059,054 | 10/1962 | Reiter | 179/1.5 M |
| 3,213,199 | 10/1965 | Snow | 179/1.5 M |
| 3,879,578 | 4/1975 | Wildi | 179/1.5 M |
| 3,980,827 | 9/1976 | Sepmeyer et al. | 179/1.5 M |
| 3,985,200 | 10/1976 | Sepmeyer | 179/1.5 M |
| 3,985,957 | 10/1979 | Torn | 179/1.5 M |
| 4,010,324 | 3/1977 | Jarvis et al. | 179/1 P |
| 4,024,535 | 5/1977 | Goldstein | 179/1 AA |
| 4,052,564 | 10/1977 | Propst et al. | 179/1.5 M |
| 4,054,751 | 10/1977 | Calder et al. | 179/1.5 M |
| 4,059,726 | 10/1977 | Watters et al. | 179/1.5 M |
| 4,098,370 | 7/1978 | McGregor et al. | 179/1.5 M |
| 4,185,167 | 1/1980 | Cunningham et al. | 179/1.5 M |
| 4,280,019 | 7/1981 | Propst et al. | 179/1.5 M |
| 4,319,088 | 3/1982 | Orfield | 179/1.5 M |

OTHER PUBLICATIONS

"Sound Solutions for Office Privacy", Miller 1976.

*Primary Examiner*—Sal Cangialosi

*Attorney, Agent, or Firm*—Kenway & Jenney

[57] ABSTRACT

The partition system disclosed herein incorporates apparatus for generating a speech masking acoustic field. Respective speakers are mounted near the bottom of each of a plurality of partition panel segments defining each work space and are aimed horizontally. These speakers are driven by respective signals which are subjectively incoherent as to frequencies of interest in the masking spectrum, thereby to provide a sound field without perceptible discontinuities.

10 Claims, 6 Drawing Figures

PARTITION SYSTEM FOR OPEN PLAN OFFICE SPACES

BACKGROUND OF THE INVENTION

The present invention relates to a partition system for providing speech privacy in open plan office spaces and more particularly to such a system providing a speech masking acoustic field.

While speech privacy can be obtained by effecting isolation i.e. the providing of barriers between different conversations, the extent to which such isolation can be created in open plan office spaces is highly limited. It has long been recognized, however, that effective speech privacy is determined not only by the degree of isolation but also by the level of unobtrusive background noise. To this end, various schemes have been developed for generating broadband acoustic fields which unobtrusively raise the background noise level and therefore increase effective speech privacy without interfering with productivity or being an annoyance. The most successful systems of this type have been those which employ multiple, independently driven speaker systems mounted above dropped ceilings over the office space. The plenum, that is, the space between the dropped ceiling and the structural ceiling, acts as a chamber which helps to distribute the sound energy from each of the speakers and thereby minimizes the perception of discrete sound sources. In other words, the masking sound is relatively uniformly distributed and does not appear to be coming from any particular point as a person moves through the office space. Such a system is described in U.S. Letters Pat. No. 4,059,726 issued on Nov. 22, 1977 to Bill G. Watters, Michael Nacey, and Thomas R. Horrall.

Plenum-mounted speaker systems, while highly effective, are initially expensive to install and are very difficult to move or modify as office requirements change. Since the transmission acoustic properties of the dropped ceiling may be markedly different at the location of light fixtures and air conditioning outlets, it may be necessary to employ individually-fitted acoustic blankets around such fixtures. A further problem is that some codes have required that all the wiring for such speaker systems be installed in conduit. The cost of this conduit wiring may equal the basic cost of the system itself.

Various attempts have been made to provide furniture-mounted masking noise sources but these have been largely unsuccessful in that the individual sound sources were easily locatable by ear as well as visually. The ability to perceive the location of the sound sources was typically due to the non-uniformity of the acoustic field created, as well as to the typical visually obvious mounting of the sound generator. Attempts to minimize the non-uniformity of the field, e.g. by directing the sound upward so that it was reflected back off the ceilings, were largely ineffectual. Consciousness of the presence of the sound sources generally made their existence annoying to office workers in the supposedly improved office space and the usual response was to make innapropriate adjustments to the sources or even to completely turn them off.

Among the several objects of the present invention are the provision of a partition system for open plan office spaces which provides effective speech privacy; the provision of such a system which employs the generation of a broadband masking sound field; the provision of such a system in which the sound field is perceived as uniform; the provision of such a system in which the sources of the sound field are not readily locatable; the provision of such a system which provides both isolation and a masking sound field; the provision of such a system which is easily installed; the provision of such a system which is highly reliable; and which is of relatively simple and inexpensive construction. Other objects and features will be in part apparent and in part pointed out hereinafter.

SUMMARY OF THE INVENTION

Contrary to the conventional wisdom in the art, the speakers generating the masking acoustic field are not mounted high or aimed upwardly. Rather, the speakers are furniture-mounted at a relatively low level, e.g. ankle level, and are aimed horizontally. By mounting the speakers at a minimal height above floor level, the location of the individual speakers becomes imperceptible to the office workers if measures are taken to effect uniformity and incoherency among the several sound sources. Subjective localization is also reduced by having the speakers mounted low and horizontally aimed. In this way, as an occupant approaches a particular speaker, his ears move progressively off-axis with respect to that speaker and thus its effective contribution to the composite masking sound is reduced.

Briefly, the present invention involves a partition system for open plan office spaces in which each of a plurality of vertical partition panel segments employs a loudspeaker assembly mounted in an aperture in the panel, approximately seven inches above floor level. The loudspeaker assemblies are designed to provide essentially similar front and back acoustic radiation characteristics. Signal source means are employed for generating a plurality of separate broadband noise signals, having spectral contents adjusted for the characteristic of the loudspeaker assemblies so as to produce, adjacent the respective panel, an acoustic spectrum appropriate for speech privacy masking, the different signals being incoherently related as to significant frequencies within the masking spectrum. Each of the signals is applied to energize a respective speaker assembly radiating into each space defined by the panels, thereby to create an essentially uniformly distributed masking field in each such space while minimizing perceptible acoustic patterns in the field which would be disturbing or cause the positions of the loudspeaker assemblies to be apparent.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
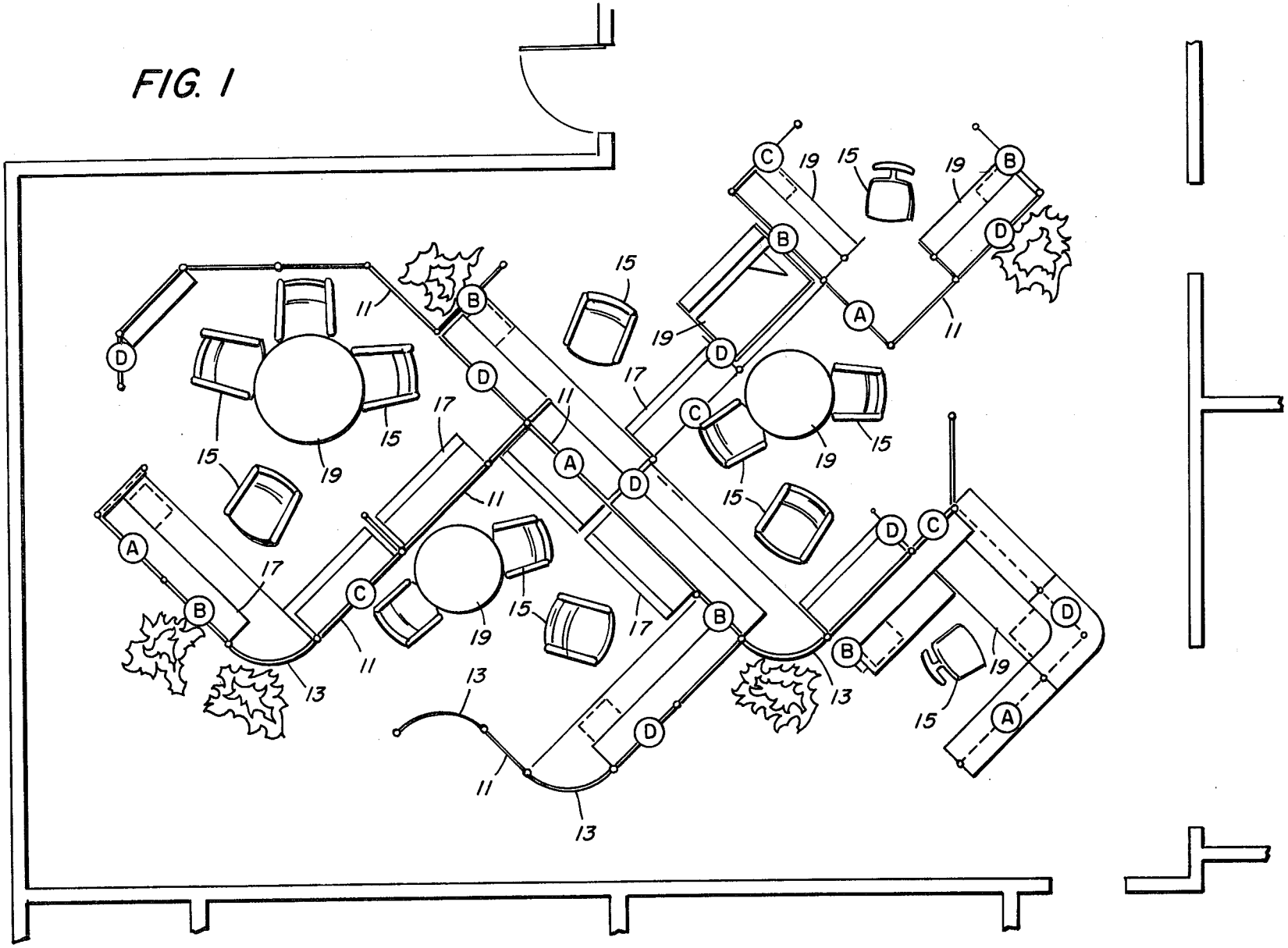
FIG. 1 is a plan system of an open plan office space employing a partition system according to the present invention.

A typical open plan office is illustrated in FIG. 1. Utilizing the open plan concept, a large room, structurally undivided, is partitioned into separate offices or work spaces using free standing partitions. In the system illustrated in FIG. 1, the partitions are made up of a plurality of panel segments, both straight, indicated by reference character 11, and curved, indicated by reference character 13. The panel segments are arranged to form separate areas in which typical office furniture may be arrayed, i.e. chairs 15, bookcases 17, and tables 19. Furniture heights and openings are chosen so as not to obstruct the sound sources described hereinafter insofar as possible. In systems where normal conversational privacy is adequate, the panel segments are typically approximately 60 inches tall. Where a greater level of privacy, e.g. so-called confidential level privacy, is required, the panels will be typically 80 inches high, these being industry standard values.

In accordance with the practice of the present invention, the partition panel segments 11 and 13 not only provide acoustic isolation between the various work spaces but also incorporate apparatus for generating a broadband speech masking acoustic field. As illustrated in the cross-sectional view of FIG. 2, each panel segment comprises a flat central core 25 constructed of a hard dense material, e.g. masonite, faced on each side with a porous sound absorbing material, e.g. fiberglass acoustic batting 27. As is understood, the hard dense material acts primarily as isolation to prevent transmission of acoustic speech energy through the partition segment while the fiberglass acts as a sound absorber generally reducing reflected and reverberant speech energy.

Figure 2:
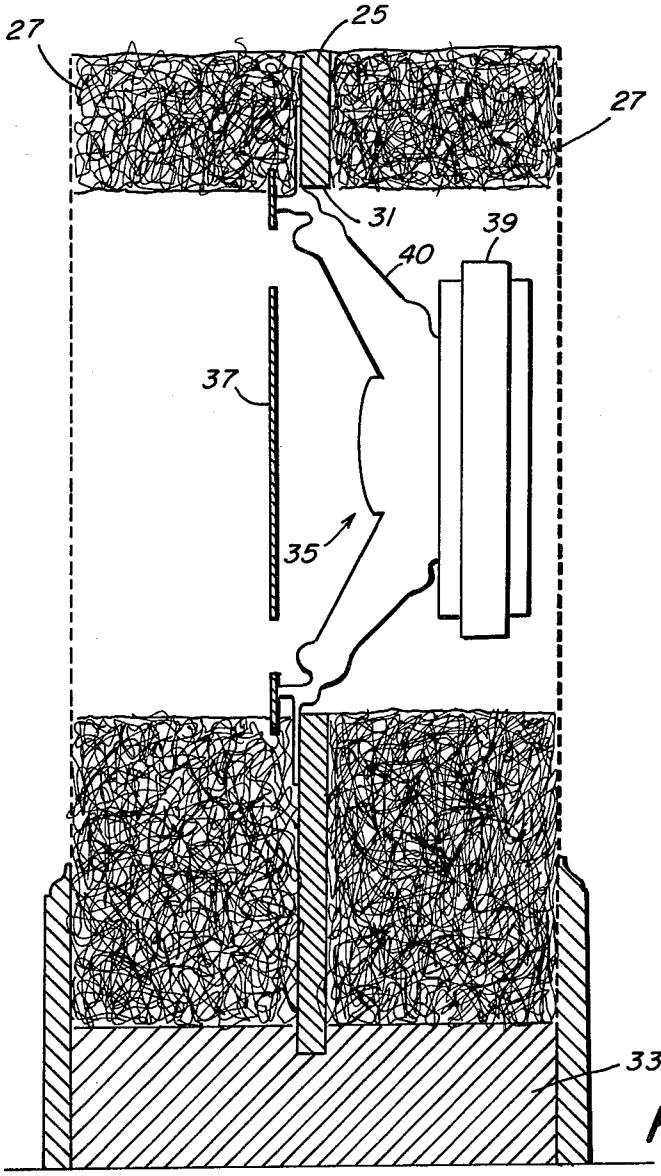
FIG. 2 is a sectional view of one of the partition panel segments employed in the system of FIG. 1, showing the panel construction and the mounting of a loudspeaker assembly therein.

Of the panel segments defining or partially enclosing each work space, at least three include speaker-mounting apertures such as that indicated at 31 in FIG. 2. These speaker-mounting apertures are centered at ankle height, e.g. approximately seven inches above floor level, providing room for a frame or base structure as indicated at 33.

The partition panel segments may be provided with a wireway through which a.c. power and telephone lines are installed and these same wireways can be utilized to energize the speakers from a source electronics package which is common to a group of interconnected partition panel segments. As indicated previously, the low mounting height and horizontal aiming are advantageous in that it removes the sound sources from head level of the office occupants in either a standing or sitting posture and also reduces the ability of the occupant to localize the sound source. As long as the speakers are mounted relatively low, the floor itself acts as a reflecting and dispersing mechanism without developing significant acoustical interference anomalies in the frequency range of interest.

Figure 3:
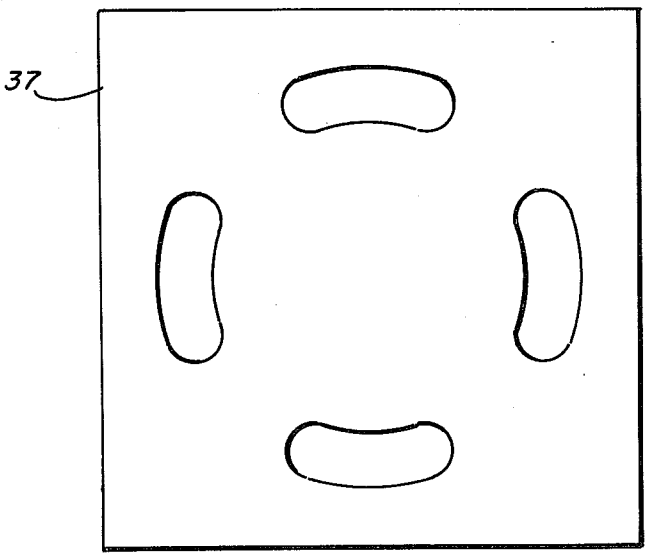
FIG. 3 is a face view of the loudspeaker assembly showing the arrangement of a baffle applied to a loudspeaker to obtain essentially similar front and back acoustic radiation characteristics.

In the embodiment illustrated, the speaker assemblies comprise conventional cone type moving coil permanent magnet loudspeakers 35 each of which is provided, over its front face, with a baffle 37 which balances the front and back acoustic radiation characteristics. The presently preferred baffle pattern is illustrated in FIG. 3. As is understood, conventional cone type loudspeakers will radiate high frequencies much more readily from the front than from the back if left unbaffled, since the magnet structure 39 and the basket 40 on which the magnet structure is mounted will obstruct radiation from the back face of the cone. The baffle 37 acoustically approximates the basket structure in front of the cone so that the radiation characteristics are essentially similar both to the front and to the back. This structural feature is important in obtaining, on both sides of each partition panel segment, a distribution of frequency components which are desirable for masking purposes as indicated previously.

Figure 4:
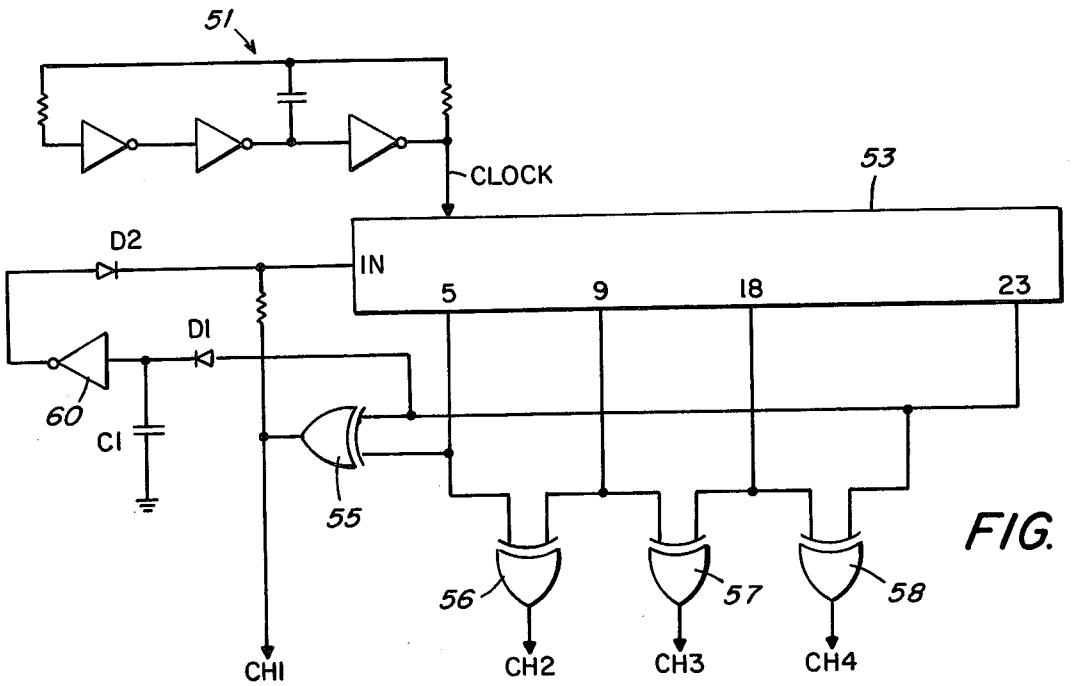
FIG. 4 is a schematic circuit diagram of a pseudo-random signal source employed in energizing the loudspeakers utilized in the partition system of FIG. 1.

In order to prevent spatial nonuniformities introduced by reinforcement or cancellation of the acoustic signals originating from different loudspeakers, the present invention also contemplates that at least three different signals be radiated into each office space defined or enclosed by the partition segments. Though the signals may be generated by shared random or pseudo-random number generator circuitry, they should be sufficiently distinct enough in content so as to be subjectively incoherent within the range of frequencies which are of interest for speech privacy masking. Circuitry for generating four such signals is illustrated in FIG. 4. As may be seen, this circuitry includes a twenty-three stage shift register 53 driven by a clock oscillator 51 operating at a frequency in the order of 90 kHz. Feedback is provided to the input of the shift register through an exclusive-OR (XOR) gate 55 which combines signals from the fifth and twenty-third stages of the shift register. The output signal from XOR gate 55 is also utilized as the initial signal source for the first audio channel. The second initial audio signal is obtained from an XOR gate 56 which combines the signals from the fifth and ninth stages of the shift register. The third and fourth channels are driven respectively from XOR gates 57 and 58 which combine, respectively, output signals from the ninth and eighteenth stages and from the eighteenth and twenty-third stages. As will be understood by those skilled in the art, the output signals obtained from the gates 55–58 will comprise essentially similar sequences of transitions but will be sufficiently displaced in time so as to be subjectively incoherent in the masking frequencies of interest. The network comprising diode Dl and D2, inverter 60 and capacitor Cl provides for positive initial starting of the pseudo-random sequence in essential conventional fashion.

Figure 5:
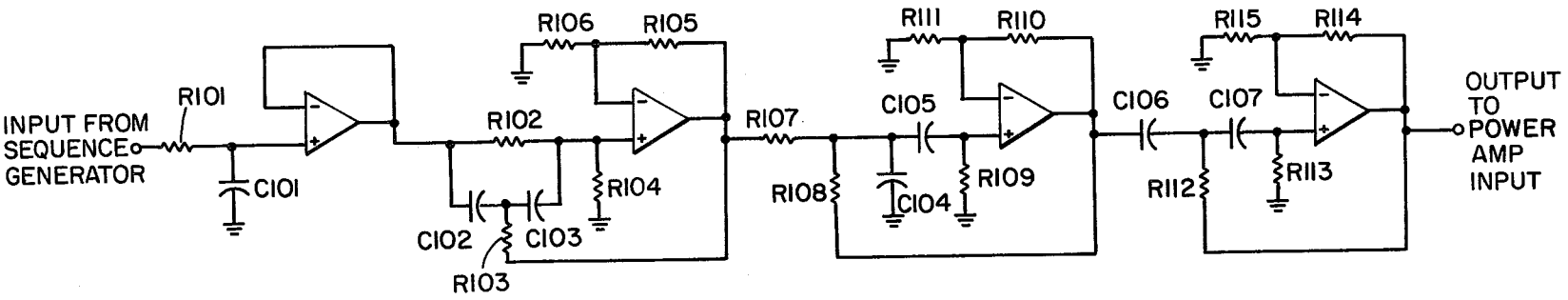
FIG. 5 is a schematic circuit diagram of filter circuitry employed in modifying the spectrum of the signals generated by the source circuitry of FIG. 4.
Figure 6:
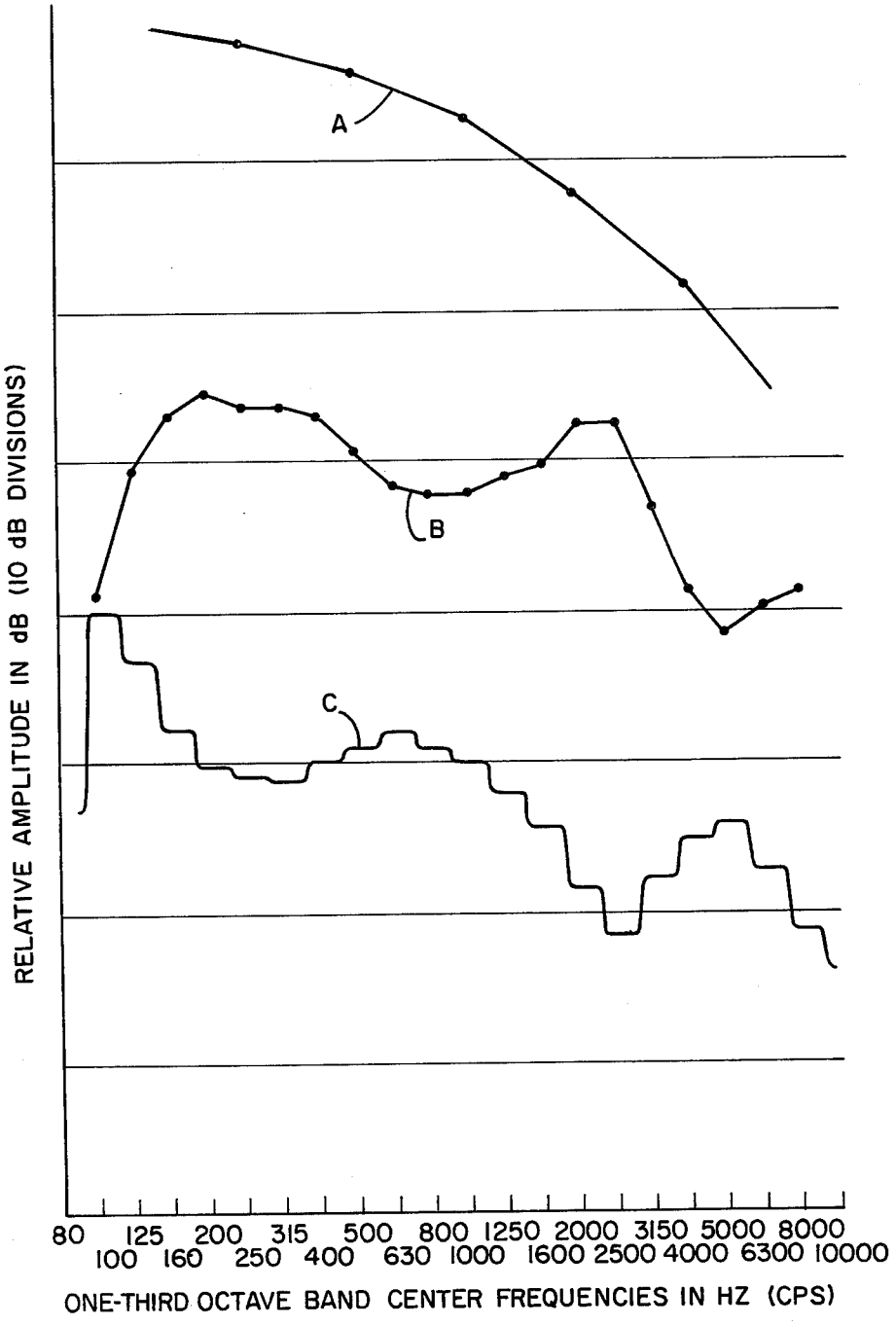
FIG. 6 is a diagram representing electrical and acoustic spectra useful in understanding the operation of the invention.

Each of the initial audio signals is applied to a respective filter to generate an appropriate spectrum for speech masking, taking into account the frequency response of the loudspeaker units. Appropriate filter circuitry is illustrated in FIG. 5. As indicated previously, a tailored noise spectrum has been found to be desirable for speech masking. A preferred such spectrum is indicated at A in FIG. 6. The average space response of a group of commercially available cone type loudspeaker modified by the baffle 37 of FIG. 3 is represented by curve B while curve C represents an empirically determined electrical signal spectrum suitable for driving such speakers to suitably approximate the desired acoustic spectrum. The filter circuitry of FIG. 5 yields approximately this spectrum and the values of the various frequency-determining components are given in the following table.

TABLE

| | | | |
|---|---|---|---|
| R 101 | 17.8K | C 101 | .082 uF |
| R 102 | 21.5K | C 102 | .012 uF |
| R 103 | 1.21K | C 103 | .012 uf |
| R 104 | 10.7K | C 104 | .012 uf |
| R 105 | 12.1K | C 105 | .012 uf |
| R 106 | 100K | C 106 | .082 uf |
| R 107 | 12.1K | C 107 | .082 uf |
| R 108 | 12.1K | | |
| R 109 | 26.1K | | |
| R 110 | 46.4K | | |
| R 111 | 100K | | |
| R 112 | 6.81K | | |
| R 113 | 56.2K | | |
| R 114 | 17.8K | | |
| R 115 | 100K | | |

Each of the four channels, after filtering, is applied to a suitable power amplifier (not shown) to drive a respective subgroup of the speaker assemblies. As indicated previously, it is desirable that at least three different channels be radiated into each workspace. In the embodiment illustrated, the four channels are conveniently designated A-D and, in FIG. 1, the locations of speakers radiating these different channels are designated by circles containing the corresponding alphabetical designation.

The use of at least three separate signals to energize loudspeakers radiating into each of the work spaces is important in order to avoid reinforcement and cancellation (interference) effects. If only one or two signals are utilized, these reinforcing and cancellation effects will cause an apparent pulsation or perceptible spatial variation in acoustic field intensity as one moves across the work space. This is profoundly disturbing to occupants. Further, the resultant non-uniformity in the acoustic field means that the locations of the speakers are more likely to be perceived, again a psychologically undesirable attribute. When three or four different signals are utilized, however, which signals are incoherent as to the frequencies of interest in the masking spectra, office occupants are generally unaware that a masking source is present at all and if asked to locate such a source will typically indicate that the source is perceived as being above them. This response is perhaps based on prior associations or the presence of somewhat similar air conditioning noises. Subjective localization is also reduced by having the speakers mounted low and horizontally aimed. In this way, as an occupant approaches a particular speaker, his ears move progressively off-axis with respect to that speaker and thus its effective contribution to the composite masking sound is reduced. The creation of perceived uniformity is also enhanced, by having the individual loudspeaker assemblies radiate from both sides of each of the respective partition panel segments. In other words, the speakers radiate as dipoles and the reduction in cancellation provided by the panels is reduced as the listener approaches a panel edge, again tending to defeat subjective localization.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A partition system for open plan office spaces, said system comprising:

a plurality of vertical partition panel segments, said panel segments each including at least one speaker mounting aperture adjacent floor level;

in each of said apertures, a loudspeaker assembly providing essentially similar front and back acoustic radiation characteristics, said loudspeaker assembly being aimed horizontally along the floor, whereby the ears of a person walking toward the respective panel segment move progressively off axis as the speaker assembly is approached; signal source means for generating a plurality of separate broadband noise signals, each signal having a spectral content compensated for the frequency response characteristic of the loudspeaker assemblies to produce, in the office space adjacent the respective panel, an acoustic spectrum for speech privacy masking, the separate signals within said plurality being incoherently related as to significant frequencies within the masking spectrum; and means for applying each of said signals to energize a respective speaker assembly radiating into each space enclosed by said panels, so that a plurality of different signals are radiated into each such space, whereby an essentially uniformly distributed masking field is created in each such space which minimizes perceptible acoustic patterns in said field that cause the positions of said loudspeaker assemblies to be apparent.

2. A partition system as set forth in claim 1 wherein said source means includes a pseudo-random number generator.

3. A partition system as set forth in claim 2 wherein said pseudo-random number generator comprises a clocked shift register having a multiplicity of stages with feedback derived from at least a pair of stages being applied to the input of the shift register.

4. A partition system as set forth in claim 3 wherein each of said loudspeaker assemblies is aimed horizontally parallel to the floor so that the ears of a person walking move progressively off axis relative to the speaker assembly as the person approaches the respective panel segment.

5. A partition system for open plan office spaces, said system comprising:

a plurality of vertical partition panel segments, each segment comprising a flat central core constructed of a hard dense material and faced on each side with a porous sound absorbing material, a plurality of said panel segments including at least one speaker mounting aperture adjacent floor level;

mounted in each of said apertures, a loudspeaker assembly providing essentially similar front and back acoustic radiation charactertistics, said loudspeaker assembly being aimed horizontally along the floor;

signal source means for generating at least three separate broadband noise signals, each signal having a spectral content compensated for the frequency response characteristic of the loudspeaker assemblies to produce, in the office space adjacent the respective panel, an acoustic spectrum for speech privacy masking, said separate signals being incoherently related as to significant frequencies within the masking spectrum; and means for applying each of said signals to energize a respective speaker assembly radiating into each space enclosed by said panels, so that a plurality of different signals are radiated into each such space, whereby an essentially uniformly distributed masking field is created in each space which minimizes perceptible acoustic patterns in said field that cause the positions of said loudspeaker assemblies to be apparent.

6. A partition system as set forth in claim 5 wherein said source means comprises a shift register having a multiplicity of stages and clocked and operated as a pseudo-random number generator and wherein each of said broadband noise signals is obtained by logically combining at least a pair of signals obtained from different stages of said shift register.

7. A partition system as set forth in claim 6 wherein each pair of signals is combined in an exclusive-OR logic gate.

8. A partition system as set forth in claim 6 further comprising a respective filter for each combined pair of signals for adjusting the spectrum in accordance with the response characteristics of the speaker assemblies.

9. A partition system for open plan office spaces, said system comprising:

a plurality of vertical partition panel segments, said panel segments each including at least one speaker mounting aperture centered in the order of seven inches above floor level; mounted in each of said apertures, a loudspeaker assembly providing essentially similar front and back acoustic radiation characteristics, said loudspeaker assembly being aimed horizontally along the floor;

a pseudo-random number source means for generating at least three separate broadband noise source signals, the different signals being incoherently related as to significant frequencies within the masking spectrum;

for each of said source signals, a respective filter for adjusting the spectral content of the signal in accordance with the frequency response characteristics of the loudspeaker assemblies to produce, in the office space adjacent the respective panel, an acoustic spectrum for speech privacy masking; and means for applying each of the filtered signals to energize a respective speaker assembly radiating into each space enclosed by said panels, so that a plurality of different signals are radiated into each such space, whereby an essentially uniformly distributed masking field is created in each space which minimizes perceptible acoustic patterns in said field that cause the positions of said loudspeaker assemblies to be apparent.

10. A partition system for open plan office spaces, said system comprising:

a plurality of vertical partition panel segments, each segment comprising a flat central core constructed of a hard dense material and faced on each side with a porous sound absorbing material, a plurality of said panel segments including at least one speaker mounting aperture adjacent floor level;

mounted in each of said apertures, a loudspeaker assembly providing essentially similar front and back acoustic radiation characteristics, said loudspeaker assembly being aimed horizontally along the floor;

a pseudo-random number generator including a clocked shift register having a multiplicity of stages and feedback derived from at least a pair of said stages;

a plurality of gate means, each operative to combine a respective pair of signals obtained from different stages of said shift register thereby to generate at least three separate broadband noise signals, said broadband noise signals being incoherently related as to significant frequencies within the masking spectrum;

for each of said broadband noise signals, a respective filter for adjusting the spectrum in accordance with the frequency response characteristic of the loudspeaker assemblies to produce, in the office space adjacent the respective panel, an acoustic spectrum for speech privacy masking; and means for applying each of said signals to energize a respective speaker assembly radiating into each space enclosed by said panels, so that a plurality of different signals are radiated into each such space, whereby an essentially uniformly distributed masking field is created in each such space which minimizes perceptible acoustic patterns in said field that cause the positions of said loudspeaker assemblies to be apparent.

* * * * *